US005651240A

United States Patent [19]

Tompkins

[11] Patent Number: 5,651,240

[45] Date of Patent: Jul. 29, 1997

[54] SADDLE HANDLE

[76] Inventor: Harry Tompkins, P.O. Box 327, Dublin, Tex. 76446

[21] Appl. No.: 495,979

[22] Filed: Jun. 28, 1995

[51] Int. Cl.[6] ..... B68C 1/20

[52] U.S. Cl. ..... 54/44.1; 16/124

[58] Field of Search ..... 54/44.1, 44.7, 54/45.1; 16/124, 110.5; 294/168, 170; 211/16, 105.2

[56] References Cited

U.S. PATENT DOCUMENTS

| | | | |
|---|---|---|---|
| Re. 33,596 | 5/1991 | Ennis | 211/105.2 |
| D. 284,296 | 6/1986 | Bossert et al. | D30/20 X |
| 1,019,662 | 3/1912 | Kroder | 211/105.2 |
| 1,576,764 | 3/1926 | Kenney | 211/105.2 |
| 2,785,453 | 3/1957 | Wentz | 16/124 X |
| 3,196,595 | 7/1965 | McKeen, Jr. . | |
| 3,312,040 | 4/1967 | Nuzzo . | |
| 3,438,177 | 4/1969 | Houston | 54/44.1 X |
| 4,287,705 | 9/1981 | Frost et al. . | |
| 4,912,809 | 4/1990 | Scheuer | 16/124 X |
| 5,101,614 | 4/1992 | Bozanich . | |

*Primary Examiner*—Robert P. Swiatek
*Attorney, Agent, or Firm*—Shoemaker and Mattare, Ltd.

[57] ABSTRACT

A saddle handle includes a pair of standards which are screwed to a saddle in place of a conventional horn. Each standard has a foot including a heel and a toe, and a vertical cylindrical post. A U-shaped handle is secured upon the posts. Handles of different heights may be interchanged to fit different riders.

4 Claims, 3 Drawing Sheets

FIG. 1
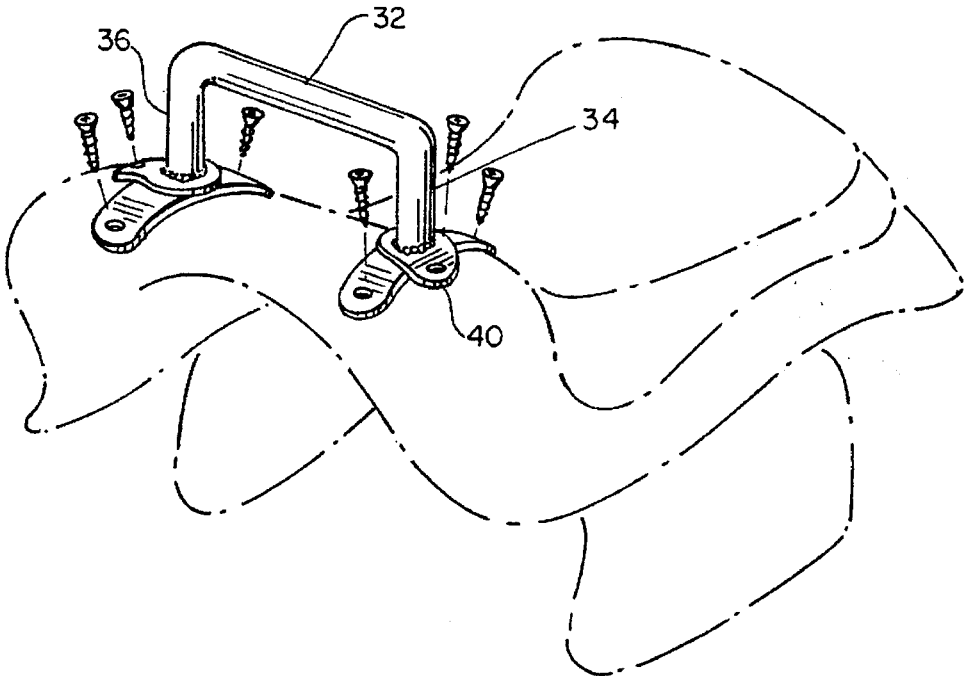
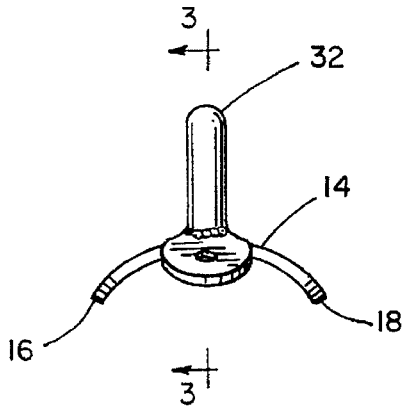
FIG. 2
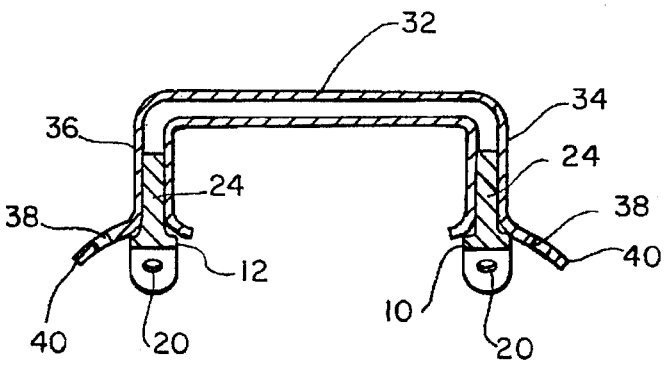
FIG. 3

FIG. 5
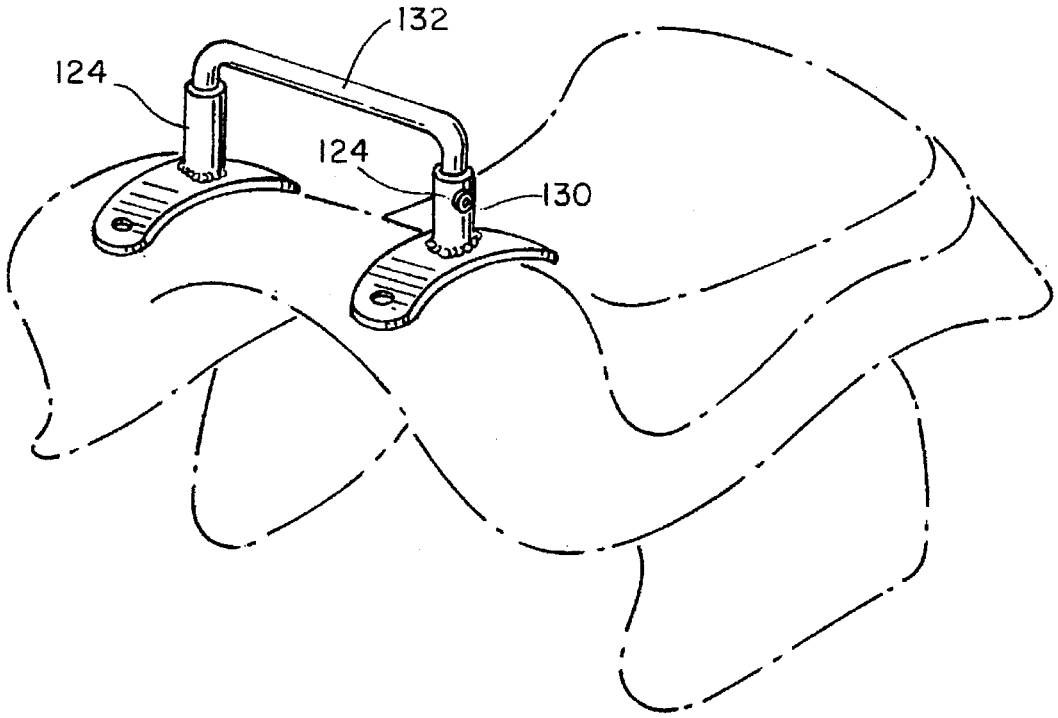
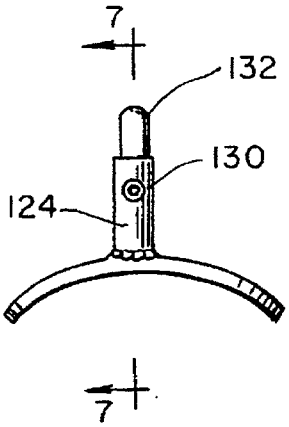
FIG. 6
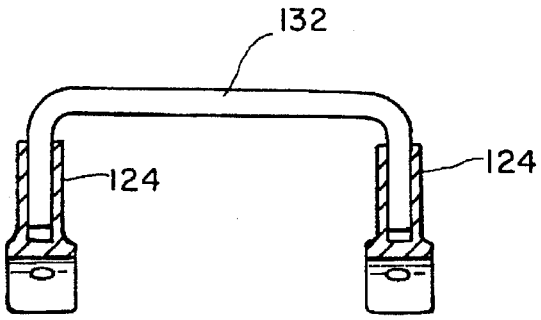
FIG. 7

SADDLE HANDLE

BACKGROUND OF THE INVENTION

This invention relates to the art of equestrian equipment, and more particularly to a saddle handle which takes the place of the conventional saddle horn.

A problem with conventional saddles is that either they have no handhold (e.g., an English saddle), or the handhold is in the form of a horn (e.g., Western saddle). Even a Western saddle is not ideal for riding an unruly or unwilling animal, for example in a rodeo. In fact, a horn can be dangerous, when the horse rolls on the rider. It would be better in such situations to have a handle expressly designed to maximize the grasping force that the rider can maintain.

Prior inventors have provided a number of non-conventional handles for saddles, in various configurations. See, for example, U.S. Pat. Nos. 3,196,595; 3,312,040; 3,438,177; 4,287,705; 5,101,614; and Design Patent 284,705.

SUMMARY OF THE INVENTION

An object of the invention is to improve the grasping power of a rider on a difficult horse.

Another object of the invention is to provide a simple handle assembly which can be manufactured easily, sold at low price, and applied to a variety of existing conventional saddles.

A further object of the invention is to enable a rider to change the height of a saddle handle, to suit his needs.

One other object of the invention is to provide saddle hardware to which straps and ropes can easily and reliably be tied.

These and other objectives are attained by a saddle handle including a pair of standards, each having a foot including a heel and a toe, and a vertical cylindrical portion into which, or onto which, the ends of a U-shaped handle are fit. In a preferred form of the invention, the handle is hollow, and its ends, which fit over the standards, are flared outward. One or more screws are passed through the flared portion directly into the saddle to retain the handle.

It is also possible to form vertical bores in the standards, and to design the handle so that its ends fit inside the bores, securing the handle directly to the standards by means of set screws or other fasteners.

The handles are preferably provided in sets having different heights, or the attachment may permit for height adjustment of a single handle.

BRIEF DESCRIPTION OF THE DRAWINGS

In the accompanying drawings,

FIG. 1 is a perspective view of a saddle handle embodying the invention;

FIG. 2 is a side elevation thereof; and

FIG. 3 is a sectional view taken on the vertical plane 3—3 in FIG. 2.

FIG. 5 is a perspective view of a modified form of the invention;

FIG. 6 is a side elevation thereof; and

FIG. 7 is a sectional view taken on the vertical plane 7—7 in FIG. 6.

DESCRIPTION OF THE PREFERRED EMBODIMENT

Figure 4:
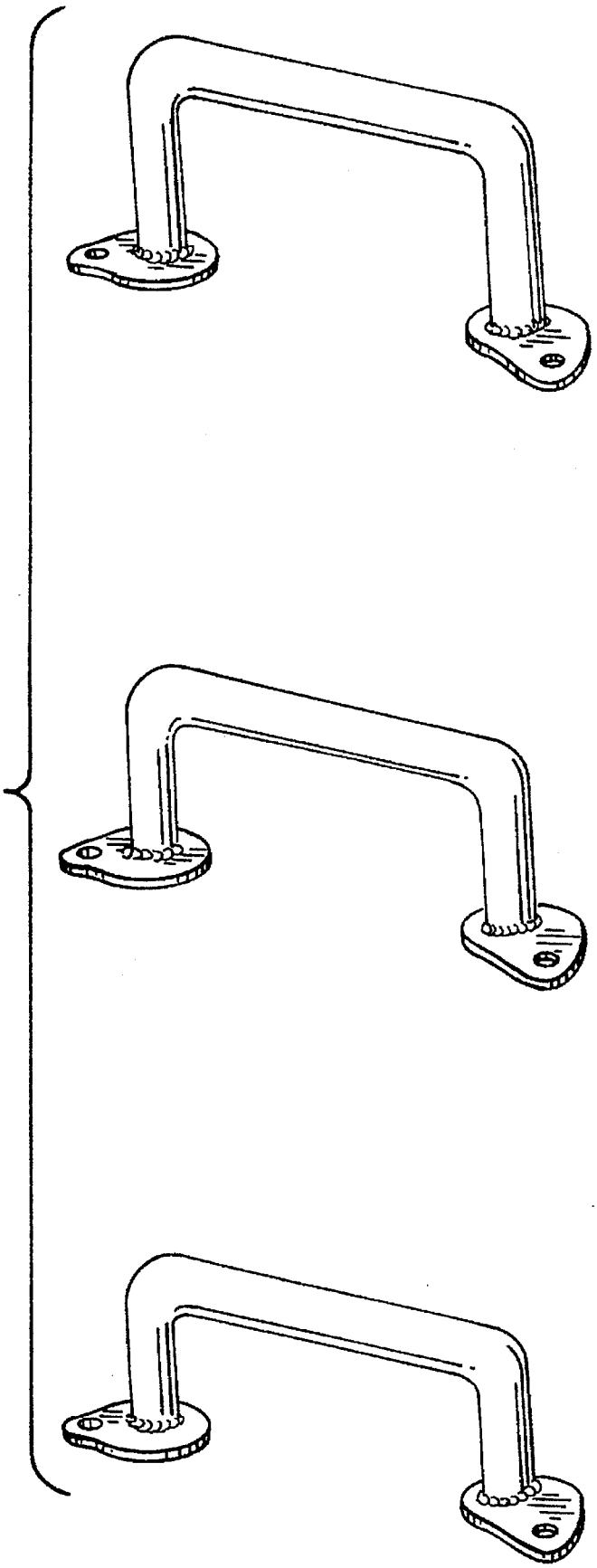
FIG. 4 shows a set of three handles, having different heights.

In FIG. 1, a saddle is shown in phantom lines to illustrate the placement of the handle described below. The inventive handle essentially replaces the conventional horn, providing a better hand hold for rodeo riders and others.

The handle assembly comprises a pair of standards 10 and 12, each having a foot 14 which may be thought of as having a heel 16 and a toe 18. The toe curves downward, to conform to the shape of the saddle swells. The heel is also curved, but to a lesser degree, also to match to the saddle shape. Countersunk holes 20 and 22 are provided in the heel and toe, respectively, for receiving attachment screws. The vertical post 24, welded to the foot, is solid in the preferred form. The post and foot are preferably both carbon steel.

Reference numeral 32 denotes a hollow, U-shaped handle whose ends 34, 36 are bent parallel to one another, so that they can fit over the respective standards. With the handle so installed, the standards can be attached to the saddle by passing screws through the holes 20, into the saddle tree. After the standards are securely attached, screws are passed through a hole 38 in each laterally protruding handle plate 40, to prevent the handle from being lifted off the standards.

Different riders may provide handles of different heights, so I prefer to make interchangeable handles of different heights, as shown in FIG. 4. Such handles may be packaged as a set, along with the standards and attachment screws.

FIGS. 5–7 show an alternative form of the invention. In this embodiment, the posts 124 are hollow, and the handle 132 is a solid member, made from steel rod stock, whose ends seat within the posts, where they are retained by set screws 130. The set screws permit a certain amount of height adjustment.

Since the invention is subject to modifications and variations, it is intended that the foregoing description and the accompanying drawings shall be interpreted as only illustrative of the invention defined by the following claims.

I claim:

1. A saddle handle comprising a pair of standards, each having a foot including a heel and a toe, and a vertical cylindrical post, a U-shaped handle having hollow ends which are bent parallel to one another, and which seat over the standards, and screws for securing the handle so that the handle cannot be lifted off the posts, the ends of the handle being flared outwardly, and wherein the handle has a pair of laterally protruding plates, each having at least one hole through which one of said screws can be passed.

2. The invention of claim 1, further comprising at least one additional handle of a different height from the first handle, so that handles can be interchanged to fit a particular rider.

3. The invention of claim 1, wherein the handle is hollow for its whole length.

4. The invention of claim 1, further comprising at least one additional handle of a different height from the first handle, so that handles can be interchanged to fit a particular rider.

* * * * *